US010611596B2

(12) United States Patent
Arthur

(10) Patent No.: US 10,611,596 B2
(45) Date of Patent: Apr. 7, 2020

(54) METHOD OF FILAMENT WINDING A VARIABLE DIAMETER GOLF SHAFT

(71) Applicant: Robin D. Arthur, San Diego, CA (US)

(72) Inventor: Robin D. Arthur, San Diego, CA (US)

( * ) Notice: Subject to any disclaimer, the term of this patent is extended or adjusted under 35 U.S.C. 154(b) by 145 days.

(21) Appl. No.: 15/893,693

(22) Filed: Feb. 12, 2018

(65) Prior Publication Data

US 2019/0248618 A1 Aug. 15, 2019

(51) Int. Cl.
*B65H 54/00* (2006.01)
*A63B 53/10* (2015.01)

(52) U.S. Cl.
CPC ..... *B65H 54/00* (2013.01); *A63B 53/10* (2013.01); *A63B 2209/02* (2013.01); *B65H 2513/108* (2013.01)

(58) Field of Classification Search
CPC .. B65H 54/02; B65H 81/06; B65H 2513/108; A63B 2209/02; A63B 2053/002; A63B 53/10; B29C 53/585; B29C 53/665
See application file for complete search history.

(56) References Cited

U.S. PATENT DOCUMENTS 3,228,616 A * 1/1966 Grosh ..... B21F 17/00 242/437
4,157,181 A * 6/1979 Cecka ..... A63B 53/10 473/319
4,283,446 A * 8/1981 McLain ..... B29C 53/665 428/105
5,873,793 A * 2/1999 Swinford ..... A63B 53/10 473/317
6,056,648 A * 5/2000 Kusumoto ..... A63B 53/10 473/319
6,287,209 B1 * 9/2001 Nakajima ..... F16C 3/026 464/181
2002/0082112 A1 * 6/2002 Unosawa ..... A63B 53/10 473/318
2005/0090326 A1 * 4/2005 Hasegawa ..... A63B 53/10 473/319
2006/0258478 A1 * 11/2006 Hsu ..... A01K 87/00 473/316
2011/0047900 A1 * 3/2011 Holmes ..... E04C 3/36 52/173.1
2018/0250563 A1 * 9/2018 Wakabayashi ..... A63B 53/10

* cited by examiner

*Primary Examiner* — Emmanuel M Marcelo
(74) *Attorney, Agent, or Firm* — N.J. Aquilino

(57) ABSTRACT

A method of filament winding a golf shaft to form an upper section, an intermediate, rapid tapered section and a lower section.

3 Claims, No Drawings

METHOD OF FILAMENT WINDING A VARIABLE DIAMETER GOLF SHAFT

BACKGROUND OF THE INVENTION

The present invention relates to golf shafts and in particular to a method of filament winding a golf shaft.

Initially wood was the preferred material for making golf shafts. Later steel and then carbon fiber reinforced with an epoxy resin, commonly referred to as graphite, became the preferred material for golf club shafts. Traditionally shafts for golf clubs have been made with a generally circular cross section that gradually tapers downwardly from the upper butt section down to the tip section where it is connected to a club head to form a complete golf club.

Historically all golf club shafts have been designed and produced with an outside diameter at the upper butt end of the shaft, where the hands of the golfer typically grip the golf club, in the range of 0.560 inches to 0.640 inches but have been known to range up to 0.845 inches in diameter. The shafts taper to a lesser diameter at the lower tip section of the shaft in the range of 0.330 inches to 0.370 inches for shafts used with wood or metal wood golf clubs. When used with irons, the tip diameter of the shaft is in the range of 0.335 inches to 0.400 inches.

Variations of golf shafts that do not taper gradually include the use of a wide variety of multiple step-down designs where the decrease in diameter between each step-down section is relatively small. Other shaft designs that alter the gradual tapering geometry of a golf shaft are disclosed in U.S. Pat. Nos. D431274, 5,316,299, 6,454,662, 5,944,618, and 6,827,656 among others.

The most employed manufacturing process for graphite shafts is termed table rolling. Specific graphite/epoxy material commonly known as prepreg, is cut into a specific shape or pattern and each piece, or pattern of prepreg is rolled onto a specifically shaped mandrel using either a flat, dual pattern rolling machine or the prepreg is applied manually. A poly tape is then wound around the prepreg layup that serves to further compact the layers and apply mechanical pressure during the curing process. After the curing hardens the resin, the poly tape is removed and the shafts are cut to length, sanded and the final paint and other cosmetics applied.

When making a shaft with complex geometric shapes and/or diameters, the table rolling method is not applicable since the flat patterns cannot apply sufficient pressure to the non-flat surfaces. The preferred method of making a geometrically different shaft historically has been by molding. These complex geometry shafts are made using a filament winding method that has no limitations of geometry and is much more cost effective than molding. Filament winding differs from table rolling in several different ways.

Specifically, designed mandrels which may be 50 to 70 inches long, are suspended horizontally under tension in a specifically designed winding machine and rotated using a computer program at different speeds to match the profile of the shaft geometry represented by the complexity of the mandrel shape. The graphite winding is fed from a supply such as a spool or supply bundle that typically goes through a resin bath but can also use pre-impregnated tows of fiber. The fibers are attached to a carriage unit that traverses back and forth along the length of the mandrel. Different speeds of both the mandrel rotation and carriage travel speed dictate the angle of the fibers and thus the design of the shaft part being wound. Known methods of manufacturing shafts in this manner use constant mandrel spin speeds and speed of the carriage traversing unit. The cured shafts are then processed similar to a table rolled shaft described above.

SUMMARY OF THE INVENTION

The present invention relates to a golf shaft and method of making the shaft that employs a rapidly tapering section approximately 13 to 20 inches below the upper butt end for iron club shafts and 14 to 26 inches for wood or metalwood type club shafts that rapidly reduces the larger diameter upper section of the shaft to a significantly smaller diameter of the bottom of the shaft. The length of the rapid taper preferably is within a range of two to five inches and reduces the larger upper section outside diameter having a range of 0.560 inches to 0.845 inches to a significantly smaller diameter at the lower section of the shaft having a smaller range of 0.335 inches to 0.390 inches.

The shaft in accordance with the present invention having a rapidly tapering section as described above acts like a whip thereby increasing the angular acceleration of the shaft during the execution of a golf swing and, in turn, increasing club head speed at the point of impact with a golf ball resulting in higher ball speed off the club face and therefore increased distance for a given swing force than with a conventional gradual taper design golf shaft.

Many obstacles had to be overcome in the development of a golf shaft formed with a rapidly tapering section. The length of the taper, the location of the tapered section, the tapered section beginning and ending outside diameter were factors initially evaluated. Additionally, an improved filament winding process was found to be required that was an improvement over conventional filament winding processes due to the requirements required to handle the changing geometry.

Evaluating the above criteria for the optimal golf shaft geometry it was determined that the length of the rapid taper section of the shaft ideally is with a range of three to five inches with a preferred optimal length of 3.25 inches. It was also determined that the rapid taper section begins at 13 to 20 inches from the butt for iron shafts and extends from 3 to 5 inches with a preferred optimal length of 3.25 inches to the lower parallel section of the shaft. For wood or metalwood shafts the tapered section begins at 14-26 inches from the upper butt end of the shaft and preferably starts at 14.5 inches from the butt end. The taper extends between 2 to 5 inches with a preferred length of 3.75 inches to the lower parallel section. The lower section is at least 24 inches in length.

Preferably the outside diameter of the butt or upper end of the shaft is 0.590 to 0.640 inches and stays constant until the upper end of the rapid taper section begins. The outside diameter of the shaft after or below the rapid taper section is 0.335 to 0.390 inches for the remaining length of the shaft to the bottom or tip end.

The unique geometry of the rapidly tapering section presented manufacturing challenges due to the high incidence of filament slippage in the tapered section. This filament slippage would result in a very inconsistent final shaft product and a high, unacceptable rejection rate of shafts using the conventional winding techniques. Because of this an improved method of filament winding was developed. Unlike the conventional method where the mandrel spin speed and the traversing unit speed are held constant, the present invention alters the speeds of both the mandrel and traverse unit.

The conventional speed of the rotating mandrel unit for making golf shafts is 140 rpm with a maximum of 180 rpm.

In accordance with the present invention a much slower speed is used when winding in the rapidly tapering area of the shaft. The preferable rotating speed of the rotating mandrel unit is 40 rpm to 55 rpm depending upon the exact taper angle when traversing the rapidly tapering area of the shaft. This represents a reduction in speed of the rotating mandrel unit that is between 2.5 and 3 times less than conventional speeds.

The conventional speed of the traverse unit is 15 inches per second. The speed of the traverse unit is also decreased at the rapidly tapering area to a speed of 3 to 6 inches per second depending upon the exact taper angle. This represents a speed reduction that is approximately one third of conventional speeds.

It will be appreciated that the speed of the rotating mandrel unit and the traverse unit is computer controlled using a program that accounts for the length and thickness of the shaft. With the present invention, the upper and lower portions of the shaft are wound at conventional speeds. Once the traverse unit reaches the rapidly tapering the program immediately adjusts the speed of the rotating mandrel unit and the traverse unit to the slower speeds described above. As soon as the end of the rapidly tapering area is reached the slower speeds of the rotating mandrel unit and the traverse unit are returned to conventional speeds.

This process is repeated until the required amount of filament fiber is wound to make the shaft. After the shaft is wound, it is tightly wrapped using a special machine that applies a 0.50" polyethylene tape that applies mechanical pressure up to 250 psi and also serves to keep the fiber/resin material stable. Then the shafts are suspended vertically in a computer-controlled oven and cured at 250-350 degrees Fahrenheit/. This allows the epoxy to chemically react and harden to make a solid structure. Using a center-less grinder on these cured structured, now the golf shaft is ready for final processing. The tip section is ground to either a 3-8" parallel section, or a 2.5-3.5" tapered section. The shafts are then sanded using a special belt sander to remove the indentations caused by the wrapping process. The shafts are then painted in a verity of ways (hand applied using a process called "squeegee", sprayed, ion-plated, etc.) The logos are then applied. The last step is to apply a urethane coating to protect the cosmetics.

If the taper angle of the intermediate section between the upper butt section and the lower parallel section is greater, the rotational speed of the mandrel slows down by an additional 10 to 25% depending upon the taper angle. If the taper angle is lesser the rotational speed of the mandrel can increase.

It will be appreciated that variations of the above process may be made in keeping with the following claims.

The invention claimed is:

1. A method of filament winding a golf shaft comprising the following steps:

winding the shaft in sequential steps on a mandrel:

winding an upper section of the shaft at a first diameter;

winding an intermediate section of the shaft at a progressively decreasing diameter to form a rapid tapering section relative to the upper section;

winding a lower section of the shaft at a second diameter smaller than said first diameter;

said method being further defined wherein said mandrel used in the filament winding process is wound at a speed of 140 rpm to 180 rpm during the winding of the upper section and the lower section and wherein the mandrel is rotated at 40 rpm to 55 rpm when traversing the intermediate section.

2. The method of claim 1 further including a filament winding step of traversing a traverse unit at the upper and lower sections of said shaft at a speed of 15 inches per second and traversing said traverse unit at the intermediate section of said shaft at a speed of 3 to 6 inches per second.

3. The method of claim 2 wherein said mandrel on which the filament winding is wound and said traverse unit that moves across the mandrel to feed filament winding across the mandrel are reduced in speed across the intermediate section; said reduction in speed of the mandrel and traverse unit is at least one third slower at the intermediate section than the corresponding speeds at the upper and lower sections.

* * * * *